United States Patent [19]

Johnson et al.

[11] 4,247,389

[45] Jan. 27, 1981

[54] DE-ASHING LUBRICATING OILS

[75] Inventors: Marvin M. Johnson; Gerhard P. Nowack; Donald C. Tabler, all of Bartlesville, Okla.

[73] Assignee: Phillips Petroleum Company, Bartlesville, Okla.

[21] Appl. No.: 92,138

[22] Filed: Nov. 7, 1979

[51] Int. Cl.[3] ..... C10G 29/00; C10M 11/00

[52] U.S. Cl. ..... 208/181; 208/182; 208/251 R; 208/251 H; 208/289

[58] Field of Search ..... 208/181, 182, 251 R, 208/251 H, 289

[56] References Cited

U.S. PATENT DOCUMENTS

| | | | |
|---|---|---|---|
| 2,271,882 | 2/1942 | Ambler | 208/179 |
| 2,545,806 | 3/1951 | Davis | 208/252 |
| 3,095,273 | 6/1963 | Austin | 423/415 |
| 3,173,859 | 3/1965 | Chambers | 208/184 |
| 3,791,965 | 2/1974 | Fitzsimons et al. | 208/179 |
| 3,879,282 | 4/1975 | Johnson | 208/184 |
| 3,923,643 | 12/1975 | Lewis et al. | 208/179 |
| 3,930,988 | 1/1976 | Johnson | 208/182 |
| 4,151,072 | 4/1979 | Nowack et al. | 208/182 |

FOREIGN PATENT DOCUMENTS 1533637 11/1978 United Kingdom .

OTHER PUBLICATIONS

W. H. McAdams, "Heat Transmission", (1933), p. 169.

*Primary Examiner*—Herbert Levine

[57] ABSTRACT

A process for the production of an essentially ash-free oil stock from a lubricating oil containing ash-forming components comprising (a) contacting said lubricating oil with an aqueous ammonium salt treating agent;

(b) removing a major portion of the water from the mixture resulting from combining said aqueous solution and said lubricating oil;

(c) heating at least a portion of the product resulting from step (b) at a temperature in the range of about 320° to about 420° C. for a period of time sufficient to decompose at least a portion of any ammonium salts of sulfonic acid and dialkyldithiophosphoric acid that are contained therein;

(d) cooling the product from step (c) to a temperature in the range of about 150° to about 180° C.; and (e) separating the solids from the product of step (d), optionally with subsequent hydrotreating and stripping of the oil thus obtained.

25 Claims, 1 Drawing Figure

DE-ASHING LUBRICATING OILS

Figure 1:
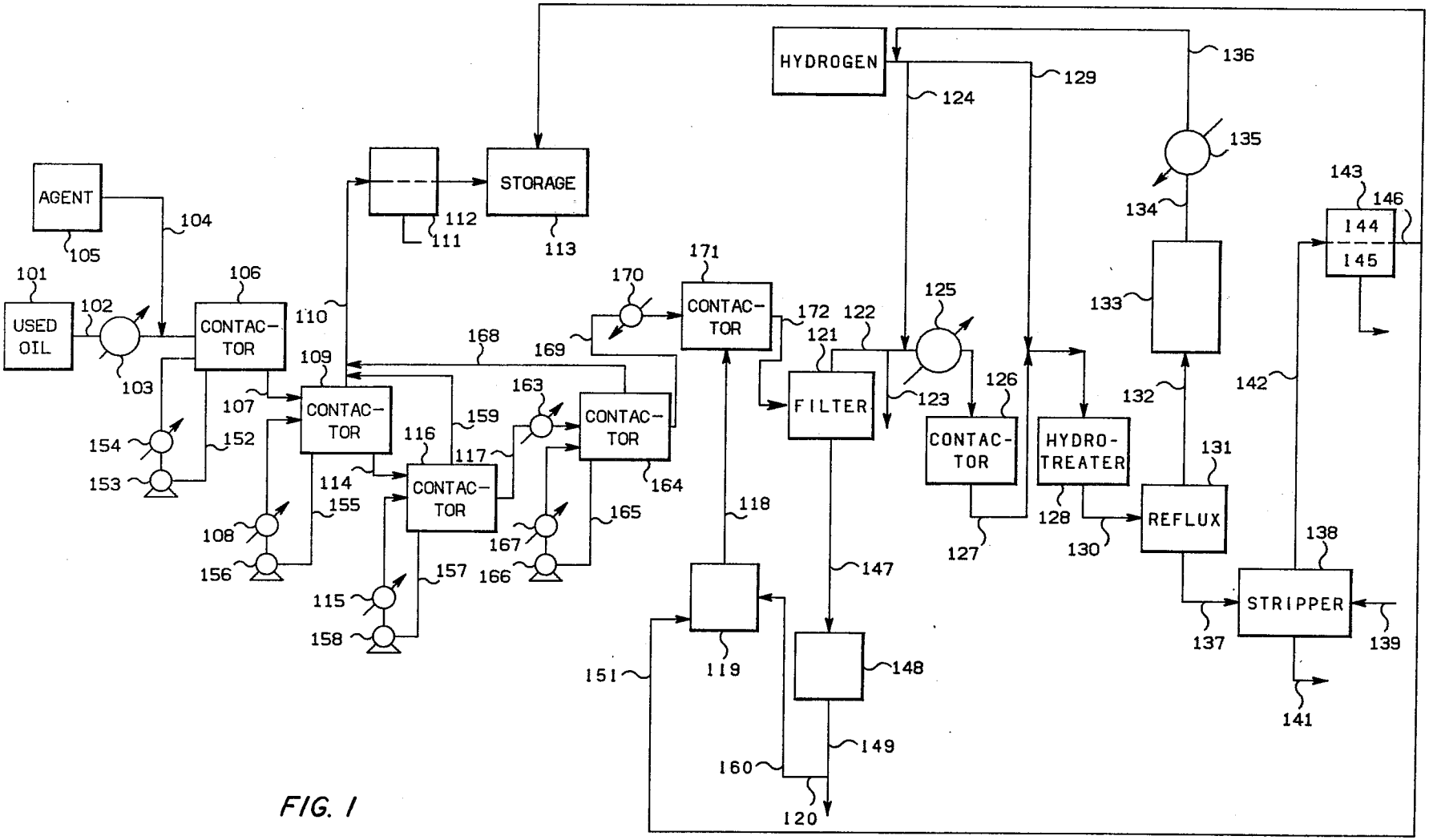

This invention relates to a method for reducing the ash-content of lubricating oil containing ash-forming components. In another aspect this invention relates to a method for the treatment of used lubricating oils to obtain purified oil suitable for use as fuel oil, in grease formulations, or in the preparation of lubricating oil formulations.

Used motor oil has been estimated as being generated in the United States at a rate of about 1.1 billion gallons per year. Some of this used oil has been used as furnace oil and some has been used on rural dirt roads for dust control. Much of the oil has been merely discarded in sewers, dumps, and back alleys. With the ever decreasing petroleum reserves, it becomes more and more essential that this used oil be saved and used as long as possible.

One major obstacle to re-use of used oil in many applications involves the presence of various ash-forming impurities that remain dispersed in the oil due to the very effective dispersant characteristics of the additives in modern day lubricant systems.

Materials contained in a typical used crankcase oil that are considered to contribute to the ash content of the oil include sub-micron size carbon particles, inorganic materials such as atmospheric dust, metal particles, lead and other metal compounds originating from fuel combustion. Besides lead, which is generally present at concentrations of 1.0 to 2.5 weight percent, appreciable amounts of zinc, barium, calcium, phosphorus and iron are also present in the used crankcase oil. Examination of the used oil under an optical microscope at 600 magnifications reveals the very effective dispersant characteristics of modern day lube oils. The particle size of the particulates is estimated from this microscopic examination to be 0.1–1.0 microns with virtually no occurrence of agglomerates in the oil.

The presence of the ash-forming components in used oil puts limits on the extent to which the material can be used economically without ecological damage. For example, reuse of the used oil as fuel oil can give rise to serious atmospheric pollution when the oil contains in excess of one percent lead. Also, such fuel oil often results in burner and refractory maintenance costs that offset the purchase price differential between used oil and regular furnace oil.

Clearly, it is in the national interest to provide economical ways of removing the impurities from used oil so that it can be reused practically.

Recently, a technique of purifying used oil has been developed in which the used oil is reacted with an aqueous solution of an ammonium salt treating agent, then the water phase is removed, and the resulting oil phase-containing mass is separated by filtration. Such a technique is described in U.S. Pat. No. 4,151,072, the disclosure of which is incorporated herein by reference.

It is an object of this invention to provide an improvement on the method disclosed in U.S. Pat. No. 4,151,072.

In another aspect it is an object of the present invention to provide a process which results in the separation of greater amounts of ash-forming components from the oil.

In yet another aspect this invention relates to increasing the rate at which the oil can generally be filtered.

Still another object of the present invention is to reduce the amount of filter aid required for rapid and effective removal of the ash components.

Other aspects, objects, and advantages of the present invention will be apparent to one skilled in the art upon study of the disclosure, the claims, and the attached drawing in which FIG. 1 is a schematic representation of a specific process employing the present invention.

In accordance with one embodiment of the present invention, a process is provided for the production of an essentially ash-free oil stock from a lubricating oil containing ash-forming components comprising:

(a) contacting said lubricating oil with an aqueous solution of a treating agent comprising a suitable ammonium salt under conditions of temperature, pressure, and time sufficient to disperse said agent in said lubricating oil and to react said agent with ash-forming components of said lubricating oil;

(b) removing a major portion of the water from the mixture resulting from combining said aqueous solution and said lubricating oil;

(c) heating at least a portion of the product resulting from step (b) at a temperature in the range of about 320° to about 420° C. for a period of time sufficient to decompose at least a portion of any ammonium salts of sulfonic acid and dialkyldithiophosphoric acid that are contained therein;

(d) cooling the product from step (c) to a temperature in the range of about 100° to about 180° C.; and (e) separating solids from the product of step (d).

The present invention is applicable to the de-ashing of oil in which ash forming components can be rendered removable by the treating agent. The invention is particularly applicable to the purification of oils that have been used for internal combustion engine lubrication purposes such as crankcase oils, e.g., in gasoline engines or diesel engines. Other sources of used oils include steam-turbine oils, transmission and gear oils, steam-engine oils, hydraulic oils, heat-transfer oils and the like.

The oils generally used for preparing internal combustion engine lubricants are the refinery lubricating cuts from paraffin-base, mixed-base, or naphthenic crudes. Their viscosities are generally in the range of from about 100 to about 1,800 SUS at 100° F. The oils also contain various additives such as oxidation inhibitors (e.g., barium, calcium and zinc alkyl thiophosphates, di-t-butyl-p-cresol, etc.), antiwear agents (e.g., organic lead compounds such as lead diorganophosphorodithioates, zinc dialkyldithiophosphates, etc.), rust inhibitors (e.g., calcium and sodium sulfonates, etc.), dispersants (e.g., calcium and barium sulfonates and phenoxides, etc.), viscosity index improvers (e.g., polyisobutylenes, poly-(alkylstyrenes), etc.), detergents (e.g., calcium and barium salts of alkyl benzene sulfonic acids) and ashless-type detergents such as alkyl-substituted succinimides, etc.

If desired, water entrained in the untreated used lubricating oil can be removed before use of same in the process of this invention. Such a separation can be readily achieved by removal of the water phase which may occur in the storage tanks for the used lubricating oil.

The ammonium salt treating agents which are useful in the process of the present invention are those selected from the group consisting of ammonium sulfate, ammonium bisulfate, ammonium phosphate, diammonium hydrogen phosphate, ammonium dihydrogen phosphate, ammonium thiosulfate, ammonium polyphosphates such as ammonium metaphosphate, urea sulfate, guanidine sulfate, urea phosphate, and guanidine phosphate, and mixtures thereof. Said treating agents can be formed in situ if desired as, for example, by combining ammonia and/or ammonium hydroxide with sulfuric acid and/or phosphoric acid and/or an ammonium hydrogen sulfate or phosphate, i.e., ammonium bisulfate, diammonium hydrogen phosphate, and/or ammonium dihydrogen phosphate. When the treating agent is formed in situ, the reactants employed can be introduced at the same time, or one after the other.

Although the concentration of treating agent in the aqueous solution of treating agent is not critical and more dilute solutions can be used, the economics of the process are enhanced by the use of relatively concentrated solutions in order that the amount of water to be removed subsequently will not be great. Generally the concentration of treating agent in the aqueous solution will be within the range of about 30 to about 95 weight percent, typically about 80 weight percent, of that in an aqueous solution that is saturated with the treating agent at 25° C. Frequently some water will be found in used oil, and in these instances the concentration of the treating agent can be adjusted accordingly.

In the process of this invention, the treating agent should preferably be employed in an amount at least sufficient to react with essentially all of the metal constituents in the used oil. Although the weight ratio of the treating agent to the oil can vary greatly, depending in part upon the nature and concentration of metal-containing components in the oil and on the particular treating agent employed, generally it will be within the range of about 0.002:1 to about 0.05:1, most often being within the range of about 0.005:1 to about 0.015:1, and typically being about 0.01:1. Although larger amounts of treating agent can be used, in most instances this would be wasteful of treating agent.

Water can be removed from the mixture resulting from the combination of the aqueous solution and the oil by any suitable means. Distillation is the preferred method of removing water. Generally, the distillation is carried out at a temperature in the range of about 100° to about 140° C. and a pressure in the range of about 5 to about 25 psig for a period of time sufficient to effect removal of a major portion of the water. Light hydrocarbons contained in the oil that boil under the distillation conditions, e.g., gasoline, will be, of course, separated from the oil along with the water.

The heating in step (c) is preferably carried out at a temperature in the range of about 340° to about 370° C. Generally, the time that a volume of oil will be exposed to heat step (c) will be in the range of about 5 minutes to about an hour, more preferably about 15 minutes to about 30 minutes.

The solids are preferably separated from the product of step (d) by filtering. Generally, it is desirable to use a filter aid in the separation process. Filter aids which are useful in the practice of this invention include those selected from the group consisting of diatomaceous earth, perlite, and cellulose fibers. Presently preferred is diatomaceous earth.

The advantages of the instant invention will now be illustrated by the following examples.

EXAMPLE 1

Four different portions of a typical used oil were subjected to different processing techniques in an attempt to remove ash forming components by filtration. The four different processing techniques were as follows:

Method 1—First, 100 g of the used oil was placed in a 250 ml beaker and heated with stirring to 350° F., then transferred to a 250 ml flask where heating was continued under nitrogen to 660° F. The oil was held at a temperature between 660° and 670° F. for 70 minutes, then allowed to cool to 220° F. The oil was then reheated to 300° F., 1.0 g of Celatom FP-4 filter aid added, and then heated to 350° F. whereupon the oil was filtered through 5 g Celatom FP-4 filter aid on Whatman No. 1 filter paper in a 5.8 cm Buchner funnel.

Method 2—Again 100 g of the used oil was placed in a 250 ml beaker and heated with stirring to 200° F. whereupon there was added thereto 6 ml of an aqueous solution containing about 273 g $(NH_4)_2HPO_4$ per liter of solution. Heating was continued to 380° F., then the mixture transferred into a flask where heating was continued under nitrogen to 660° F. The oil was held at 660° F. for 70 minutes then cooled to 180° F. The oil was then reheated to 300° F., 1.0 g of Celatom FP-4 filter aid added, and then heated to 350° F. whereupon the oil was filtered through 5 g of Celatom FP-4 filter aid on Whatman No. 1 filter paper in a 5.8 cm Buchner funnel.

Method 3—100 g of the used oil was placed in a 250 ml beaker and heated with stirring to 200° F. whereupon there was added thereto 6 ml of an aqueous solution containing about 273 g $(NH_4)_2HPO_4$ per liter of solution. Heating was continued to 380° F., then the mixture transferred into a flask where heating was continued under nitrogen to a temperature in the range of 660° to 670° F. and held at a temperature above 500° F. for 30 minutes. Then the mixture was cooled to 320° F. and 1.0 g of Celatom FP-4 added, and then heated to 350° F. whereupon the oil was filtered through 5 g of Celatom FP-4 filter aid on Whatman No. 1 filter paper in a 5.8 cm Buchner funnel.

Method 4—100 g of the used oil was placed in a beaker and heated with stirring to 200° F. whereupon there was added thereto 6 ml of an aqueous solution containing 273 g $(NH_4)_2HPO_4$ per liter of solution. Heating was continued to 350° F., then 1.0 g of Celatom FP-4 added, and the mixture held at 350° F. for another 5 minutes. Then the mixture was filtered through 5 g of Celatom FP-4 filter aid on Whatman No. 1 filter paper in a 5.8 cm Buchner funnel.

The effects of these four different processing techniques are summarized in Table I.

TABLE I

| | Raw Oil | Method 1 | Method 2 | Method 3 | Method 4 |
|---|---|---|---|---|---|
| Filtrate Rate Gal/Hr - ft$^2$ | — | 16.1 | 28.9 | 26.2 | 23.7 |
| Sulfated Ash[1], wt % | 1.21 | 0.44 | 0.01 | 0.02 | 0.13 |
| Elements[2], ppm | | | | | |
| Ag | 1 | 0.6 | 0.5 | 0.4 | 0.7 |
| Al | 29 | 7 | 0.3* | 0.3* | 1 |
| Cr | 8 | 5 | 0.3* | 0.3* | 0.5 |
| Cu | 33 | 2 | 0.3* | 0.3* | 3 |
| Fe | 243 | 233 | 0.3* | 0.3* | 12 |
| Mg | 68 | 179 | 0.5 | 0.4 | 4 |
| Na | 13 | 67 | 1 | 9 | 90 |
| Ni | 3 | 1 | 1 | 7 | 1 |
| Pb | 5640 | 801 | 5* | 5* | 20 |
| Si | 60 | 5 | 0.3* | 0.3* | 6 |
| Ti | 5 | 0.5 | 0.3* | 0.3* | 0.3* |
| B | 16 | 8 | 1 | 1* | 9 |
| Ba | 195 | 150 | 0.3* | 0.3* | 0.4 |
| Ca | 859 | 761 | 1* | 1* | 7 |

TABLE I-continued

| | Raw Oil | Method 1 | Method 2 | Method 3 | Method 4 |
|---|---|---|---|---|---|
| K | 15 | 21 | 3 | 3 | 4 |
| Mn | 16 | 17 | 0.3* | 0.3* | 0.3* |
| Mo | 4 | 0.6 | 0.5* | 0.5* | 0.5* |
| P | 1120 | 856 | 136 | 116 | 767 |
| V | 0.3* | 0.3* | 0.3* | 0.4 | 2 |
| Zn | 983 | 51 | 0.4 | 0.4 | 19 |

[1]ASTM D874-72
[2]By plasma emission
*Amounts are below the detection limits; value given is the detection limit for that element.

The data indicates that Method 1, the heat soaking treatment without the phosphate reaction, provides some reduction in the overall ash content. The most notable reductions with Method 1 were in the concentration of lead and zinc. The concentration of many of the other elements was not reduced substantially through the use of Method 1. The more notable elements in this category are barium, calcium, phosphorus, magnesium, and iron.

The data further indicate that in all cases in which the oil was reacted with the phosphates, the filtration rates and the overall ash reduction were greater than that obtained with Method 1 where high temperature heat soaking alone was employed.

The values given for Methods 2 and 3 reveal that the use of the heat soak treatment subsequent to the reaction with the phosphate provides an improvement in filtration rate and ash reduction even over Method 4, the treatment using the phosphate reaction without the heat soak step. It is further shown that for at least certain elements the heat soak treatment provides a reduction in concentration over that of Method 4 that is much greater than one would predict from effect that the heat soak alone (i.e., Method 1) had upon those elements. For example, the heat soak of Method 1 only resulted in about a 24 percent reduction in phosphorus of the raw oil whereas the heat soak of Methods 2 and 3 resulted respectively in 82 and 85 percent reductions in the amount of phosphorus present after the technique employed in Method 4. Similar observations can be made in regard to the comparative levels of reduction of zinc, calcium, boron, and iron.

It will be noted that for some elements some of the treatments evidently resulted in an increase in concentration over that of the raw oil. This phenomena is not understood at this time but it is believed that it may be at least in part a result of some interaction between the oil and the filter aid.

In any case it is noted that while the sodium content is increased with both Methods 1 and 4, it is decreased with the inventive Methods 2 and 3. This is yet another indication of the surprising superiority of the present invention over the prior art technique exemplified by Method 4.

EXAMPLE II

A number of individual samples of used motor oils having different levels of ash-forming contaminants were subjected to the reaction with $(NH_4)_2HPO_4$ and dried both with and without a subsequent heat soak period at a temperature in the range of 320° to 420° C. In all cases the samples treated with the heat soak filtered at least as fast as the samples not treated with the heat soak. Usually the samples that were subjected to the heat soak filtered at a faster rate than the corresponding samples that were not subjected to the heat soak period. In all cases the product resulting from the runs using the heat soak contained less ash than the product resulting from the corresponding oil that was not subjected to the heat treatment process.

The present invention is particularly useful in a process for converting a used oil into premium stock for the preparation of new lubricating oil. In accordance with such a process, the essentially ash free oil stock from step (e) of this invention is subjected to hydrotreating in the presence of hydrogen and a hydrotreating catalyst under conditions of temperature and pressure and time sufficient to produce a hydrotreated oil stock substantially free of organic heteroatom compounds and then stripping the hydrotreated oil to drive off light compounds boiling below the lube oil stock range.

FIG. 1 provides a schematic representation of such a process. Referring now to FIG. 1, used oil from storage tank 101 is passed via line 102 to heater 103 and contactor 106. Aqueous treating agent such as diammonium hydrogen phosphate from makeup tank 105 is introduced via line 104. If desired, agent precursors ammonia, phosphoric acid, and water can be introduced into the heated oil downstream of heater 103, thereby forming the treating agent in situ in line 102 and contactor 106. The oil from heater 103 is passed in admixture with treating agent into the first agitated contactor 106 wherein the mixture is maintained under agitation for a time sufficient to react with at least a portion of the ash-forming components in the oil. Preferably, a recycle stream is passed through conduit 152 to pump 153 and then through heater 154 before its return to contactor 106, thereby providing heat and agitation to the contents of the contactor. Stirring means also can be employed.

Thereafter the mixture is passed via conduit 107 to second contactor 109, which is maintained at a temperature in the range of about 110° to about 140° C., for a time sufficient to effect distillation of a major portion of the water and at least some of the light hydrocarbons present therein. Thus, while retained in contactor 109, essentially all of the water and at least a portion of the light hydrogen components of the mixture are removed via line 110 and passed to separator 111 wherein a hydrocarbon layer and a water layer are allowed to form. The hydrocarbon phase can then be transferred via line 112 to storage 113. The water layer can be removed and discarded or employed for any desired purpose. Preferably, a recycle stream is passed through conduit 155 to pump 156 and then through heater 108 before its return to contactor 109, thereby providing heat and agitation to the contents of the reactor. Stirring means also can be employed.

The resulting mixture comprising a hot oil phase which is essentially free of water is passed via conduit 114 to a third contactor wherein it is subjected to agitation and a temperature in the range of about 140 to about 200° C. to remove additional water and lighter components. Preferably, a recycle stream is passed through conduit 157 to pump 158 and then through heater 115 before its return to contactor 116, thereby providing heat and agitation to the contents of the contactor. Any residual water and light hydrocarbons are removed from contactor 116 via line 159.

If desired, any one or two or all of contactors 106, 109 and 116 can be provided with jackets heated by steam or other source of heat to aid in maintaining the contents of the contactors at the desired temperatures. Any one or two or all of contactors 106, 109 and 116 can be equipped with stirrers to provide additional agitation. in an operable but presently less preferred arrangement, a stirrer in any one or more of the three contactors can be used instead of the recycle system employed with the corresponding one or more of the three contactors, any additional heating being provided by heaters in the line ahead of the contactors and/or by heated jackets around the contactors. Also, if desired, any one or two or all of conduits 103, 107 and 114 can feed into the recycle stream for contactors 106, 109 and 116, respectively, i.e., into conduits 152, 155 and 157, respectively, instead of directly into the respective contactor as shown. In one preferred technique the feed in conduit 102, rather than being passed directly into contactor 106, is passed into conduit 152 at the inlet side of pump 153. In a still more preferred technqiue, pump 153 is a high-volume pump that will cause the oil to flow in the turbulent flow range so as to promote heat transfer and decrease scaling in the conduit 152.

The heated oil from contactor 116 is passed via conduit 117 through heater 163 to a fourth contactor 164 wherein the mixture is subjected to agitation at a temperature in the range of about 320° to about 420° C. for a period of time sufficient to result in a product which when later filtered will contain less ash than it would contain if it had not been so heated. Preferably, a recycle stream is passed through conduit 165 to pump 166 and then through heater 167 before its return to contactor 164, thereby providing heat and agitation to the contents of contactor 164. Any residual water or light components can be removed from contactor 164 via line 168.

Treated oil from contactor 164 is passed through conduit 169 through a cooler 170 wherein the oil is cooled to a temperature in the range of about 150° to about 180° C. and then passed into a fifth contactor 171 wherein it is admixed with filter aid provided via conduit 118, preferably as a slurry in light hydrocarbons provided from makeup tank 119. In a presently, preferred embodiment, not illustrated, the oil from contactor 164 is cooled at least in part as a result of passing in indirect heat exchange with the feed passing through line 102 whereby the heat in the oil in line 120 is used to heat the feed oil in line 102.

Following admixture of filter aid, the resulting mixture is passed via line 172 to filter 121, which optionally can be precoated with filter aid. The use of the heat soak step of the present invention can in many cases result in a reduction in the amount of filter aid required for a suitable filtration rate.

Filter cake from filter 121 is removed via line 147 and optionally passed to furnace 148 from which, following burning or calcination, at least a portion of the resulting ash containing filter aid can be passed to waste via line 149 or recycled via conduits 120 and 160 to slurry makeup tank 119 for further use in the system. Fresh filter aid is added through conduit 160. Light hydrocarbons for use in preparing the slurry can be recovered from the integrated process and can be passed to tank 119 via conduit 151.

The filtered oil, being essentially free of ash-forming constituents previously contained therein, is suitable for a variety of industrial uses and, if desired, can be removed from the system via line 123.

However, in the presently preferred integrated process of this invention, the hot oil following filtration is passed via line 122 to heater 125 in order to raise the oil to a temperature in the range of 200° to 480° C. for further processing. If desired, a first portion of hydrogen is added thereto via line 124. The resulting hot oil containing the added hydrogen is then passed through contactor 126 wherein decomposition is effected of the sulfonates contained in the oil.

While it is presently preferred that contactor 126 contain bauxite or an activated carbon adsorbent bed therein, this unit can employ other adsorbents such as those selected from the group consisting of silica gel, clay, activated alumina, combinations thereof, and the like. The adsorbent serves to effect breakdown and decomposition of the ammonium salts of sulfonic acids and the ashless detergents contained in the oil. The adsorbent further serves to collect a small portion of the resulting products and thus precludes passage of such undesirable decomposition products to the hydrotreater. Such adsorbents can be regenerated by conventional means and reused.

The inventive heat soak step results in a substantial decrease in the amount of sulfonates and ash in the filtered oil, and thus reduces the amount of solid absorbent that must be used in the system.

Preferably, the adsorbent contains about 0.2 to about 20 weight percent of at least one metal selected from the group consisting of Group VIB and Group VIII metals, this weight percent being based on the total weight of modified adsorbent. This modified adsorbent can be prepared by impregnation of the adsorbent with an aqueous solution of a water-soluble compound of a Group VIB or Group VIII metal, followed by evaporation of water. Water-soluble compounds presently preferred for this use are iron compounds such as ferric ammonium oxalate, ferric ammonium citrate, ferric sulfate, and ferrous ammonium sulfate.

The resulting treated oil is thereafter passed from contactor 126 via line 127 to hydrotreater 128, which is maintained at an elevated temperature, which serves to effect destruction of the various additive systems previously added to the original oil stock. Hydrogen for the desired hydrotreating reaction is introduced to the system via line 129 in communication with line 127 or, if desired, directly to the hydrotreater 128.

In hydrotreater 128 the oil is subjected to hydrogenation conditions in the presence of a catalyst so as to hydrogenate unsaturated materials and to effect decomposition of residual sulfur, oxygen and nitrogen bodies so as to yield an oil product suitable for further purification to a lube stock.

Suitable catalysts for use in hydrotreater 128 are those selected from the group consisting of Group VIB and Group VIII metals and combinations thereof, on a refractory support, used in conventional hydrodesulfurization processes.

Following hydrotreating, the resulting oil is passed via conduit 130 to separator-reflux column 131 which serves to remove water and various other by-products of the previous treatments from the oil. If desired, and particularly when HCl is present, water can be injected into column 131 to aid in removal of most of any HCl and part of the $H_2S$ and $NH_3$ as water-soluble salts. Overhead from column 131 comprising hydrogen, $H_2S$, $NH_3$, and water is passed via line 132 to sulfur removal unit 133. This unit, for example, a bed of zinc oxide, serves to remove $H_2S$ (sulfur) from the hydrogen stream. The resulting sulfur-free hydrogen stream is thereafter passed via line 134 to cooler 135. Ammonia is then removed, for example, by water washing in an ammonia removal unit (not shown) in conduit 136. Hydrogen is then recycled via conduit 136 to line 129.

An example of another material useful in unit 133 is iron oxide. Alternatively, a solvent process can be employed using substances such as alkanolamines and/or other amines, the $H_2S$ subsequently being oxidized to sulfur in a Claus-type process.

The bottoms product from column 131 is passed via line 137 to lubestock stripper 138 wherein a further steam treatment is carried out by introduction of steam via line 139.

Stripping, preferably steam stripping, of the oil is essential to the integrated process of this invention since it serves to remove those light hydrocarbon products boiling below the oil, such as kerosene or heavy gasoline, which have remained entrained in the oil or which are by-products of the hydrogenation treatment. Alternatively, gas stripping such as with hydrogen can be employed.

The resulting hot stripped product, consisting essentially of a pure lube oil stock, following cooling such as by use in heat exchanger 125, is therefter passed via line 141 to a lube oil stock product tank (not shown) for storage and subsequent use as an additive-free lube oil stock suitable for reformulation with additives as desired.

Overhead from stripper 138, which consists essentially of fuel oil and water, is passed via line 142 to settler 143, where a hydrocarbon phase 144 and a water layer 145 are allowed to form. The hydrocarbon layer 144 is removed via line 146 and combined, if desired, with the hycarbon phase in storage tank 113 for further use or reycled to filter aid makeup tank 119 via line 151. The small amount of gases present in line 146 can be removed by flashing.

Depending upon the feedstock, treating agent and other characteristics of a particular operation, as one skilled in the art in possession of this disclosure will understand, the specific conditions of operation given below can vary, preferably within the approximate ranges which are also given.

| Ref. No. | Unit Description | Typical | Approximate Preferred Ranges |
|---|---|---|---|
| 103 | Heater | Temperature 95° C.<br>Pressure 17 psia | 60–120° C.<br>Atmospheric-250 psia |
| 104 | Treating Agent | Weight ratio agt:oil 0.01:1 | 0.005:1–0.05:1 |
| 106 | Contactor | Temperature 95° C.<br>Pressure 17 psia<br>Time 30 minutes | 60–120° C.<br>Atmospheric-50 psia<br>10 minutes-2 hours |
| 109 | Contactor | Temperature 125° C.<br>Pressure 16 psia<br>Time 30 minutes | 110–140° C.<br>5–25 psia<br>10 minutes-2 hours |
| 116 | Contactor | Temperature 160° C.<br>Pressure 16 psia<br>Time 30 minutes | 140–200° C.<br>5–25 psia<br>10 minutes-2 hours |
| 111 | Phase Separator | Temperature 40° C.<br>Pressure atmospheric | 0–80° C.<br>Atmospheric-45 psia |
| 164 | Contactor | Temperature 360° C.<br>Pressure atmospheric<br>Time 30 minutes | 320–420° C.<br>Atmospheric-45 psia<br>5 minutes-2 hours |
| 165 | Contactor | Temperature 150° C.<br>Pressure atmospheric<br>Time 30 minutes | 100–180° C.<br>Atmospheric-25 psia<br>10 minutes-2 hours |
| 121 | Filter | Temperature 115° C.<br>Pressure differential plate and frame filter 80 psi<br>Continuous rotary drum filter 10 psi | 60–200° C.<br>5–100 psi<br>2–14 psi |
| 148 | Furnace | Temperature 760° C.<br>Pressure atmospheric | 650–870° C.<br>Substantially atmospheric |
| 118 | Filter Aid | Weight ratio aid:oil 0.01:1 | 0:1–0.15:1 |
| 124 | Hydrogen Charge | 111 vol/vol oil | 80–3000 vol/vol oil |
| 125 | Heater | Temperature 370° C.<br>Pressure 735 psia | 200–480° C.<br>150–3000 psia |
| 126 | Contactor | Temperature 370° C.<br>Pressure 735 psia | 200–480° C.<br>150–3000 psia |
| 128 | Hydrotreater | Temperature 360° C.<br>Pressure 730 psia | 200–430° C.<br>150–3000 psia |
| 129 | Hydrogen Charge | 222 vol/vol oil | 80–3000 vol/vol oil |
| 131 | Reflux | Temperature 325° C.<br>Pressure 705 psia | 290–400° C.<br>600–800 psia |
| 133 | Sulfur Removal Unit | Temperature 290° C.<br>Pressure 700 psia | 150–430° C.<br>100–3000 psia |
| 135 | Cooler | Inlet temperature 290° C.<br>Outlet temperature 55° C. | 260–370° C.<br>40–95° C. |
| 138 | Stripper | Temperature 370° C.<br>Pressure 20 psia | 280–395° C.<br>Atmospheric-50 psia |
| 143 | Settler | Temperature 55° C.<br>Pressure 16 psia | 0–80° C.<br>Atmospheric-45 psia |

Reasonable variations and modifications are possible within the scope of the foregoing disclosure, the drawings, and the appended claims of the invention, the essence of which is that there has been provided an improved method for treating used lubricating oil so as to produce an intermediate product of reduced ash content and optionally a final lube oil stock.

What is claimed is:

1. A process for the production of an essentially ash-free oil stock from a lubricating oil containing ash-forming components, said process comprising:

(a) contacting said lubricating oil with an aqueous solution of a treating agent comprising a suitable ammonium salt under conditions sufficient to disperse said agent in said lubricating oil and to react said agent with ash-forming components of said lubricating oil;

(b) removing a major portion of the water from the mixture resulting from combining said aqueous solution and said lubricating oil;

(c) heating at least a portion of the product resulting from step (b) in the temperature range of about 320° to about 420° C. for a period of time sufficient to decompose at least a portion of any ammonium salts of sulfonic acid and dialkyldithiophosphoric acid that are contained therein;

(d) cooling the product from step (c) to a temperature in the range of about 100° to about 180° C; and (e) separating solids from the product of step (d).

2. A process according to claim 1 wherein said lubricating oil is a used oil and said solids are separated from the product of step (d) by filtration.

3. A process according to claim 2 wherein the concentration of ammonium salt in said aqueous solution of a treating agent is in the range of 30 to 95 weight percent of that in an aqueous solution that is saturated with the treating agent at 25° C.

4. A process according to claim 3 wherin said treating agent is present in an amount such that the weight ratio of treating agent to used lubricating oil is in the range of 0.002:1 to 0.05:1.

5. A process according to claim 4 wherein the mixture in step (a) is maintained at the temperature of 60° to 120° C. for a period of time in the range of from 10 to 120 minutes and the mixture in step (b) is maintained at the temperature of 110° to 140° C. for a period of time in the range of from 10 to 20 minutes so as to remove said major amount of water from said mixture.

6. A process according to claim 5 wherein the mixture in step (c) is maintained in the temperature range of about 320° to about 420° C. for a period of time in the range of about 5 minutes to about two hours.

7. A process according to claim 6 wherein said ammonium salt is selected from at least one of the group consisting of ammonium sulfate, ammonium bisulfate, ammonium phosphate, diammonium hydrogen phosphate, and ammonium dihydrogen phosphate.

8. A process according to claim 7 wherein the mixture in step (c) is maintained in the temperature range of about 320° to about 420° C. for a period of time sufficient to result in the decomposition of at least a major portion of any ammonium salts of sulfonic acid and dialkyldithiophosphoric acid that are contained therein.

9. A process according to claim 8 wherein said treating agent is employed in an amount sufficient to react with essentially all of the metal constituents in the used oil.

10. A process according to claim 7 wherein a filter aid is added to said used lubricating oil prior to filtration step (c).

11. A process according to claim 10 wherein said filter aid is added in an amount such that the weight ratio of filter aid to oil is up to 0.15:1.

12. A process according to claim 6 wherein the filtered oil is subjected to additional processing comprising (f) hydrotreating the filtered oil from step (e) by contacting said oil with hydrogen and a hydrotreating catalyst under conditions of temperature and pressure and time sufficient to produce a hydrotreated oil stock substantially free of organic heteroatom compounds;

(g) stripping the hydrotreated oil of step (f) to drive off light compounds boiling below the boiling point of the desired lubricating oil; and (h) recovering the resulting stripped oil from said stripping zone as a product of the process.

13. A process according to claim 12 wherein the filtered oil from step (e) prior to being subjected to hydrotreatment in step (f) is heated to a temperature in the range of 200° to 480° C. and the heated oil is contacted with at least one adsorbent selected from the group consisting of activated carbon, silica gel, clay, bauxite and alumina.

14. A process according to claim 13 wherein said treating agent comprises diammonium hydrogen phosphate.

15. A process according to claim 13 wherein the mixture in step (c) is maintained in the temperature range of about 340° to about 370° C. for about 15 minutes to about 30 minutes.

16. A process according to claim 2 wherein the mixture in step (c) is maintained at a temperature in the range of about 320° to about 420° C. for a period of time sufficient to result in a product which when filtered will contain less ash than it would contain if it had not been so heated.

17. A process according to claim 16 wherein the filtered oil is subjected to additional processing comprising (f) hydrotreating the filtered oil from step (e) by contacting said oil with hydrogen and a hydrotreating catalyst under conditions of temperature and pressure and time sufficient to produce a hydrotreated oil stock substantially free of organic heteroatom compounds;

(g) stripping the hydrotreated oil of step (f) to drive off light compounds boiling below the boiling point of the desired lubricating oil; and (h) recovering the resulting stripped oil from said stripping zone as a product of the process.

18. A process according to claim 17 wherein the filtered oil from step (e) prior to being subjected to hydrotreatment in step (f) is heated to a temperature in the range of 200° to 480° C. and the heated oil is contacted with at least one adsorbent selected from the group consisting of activated carbon, silica gel, clay, bauxite and alumina.

19. A process according to claim 17 wherein said ammonium salt is selected from at least one of the group consisting of ammonium sulfate, ammonium bisulfate, ammonium phosphate, diammonium hydrogen phosphate, and ammonium dihydrogen phosphate.

20. A process according to claim 19 wherein the mixture in step (a) is maintained at the temperature of 60° to 120° C. for a period of time in the range of from 10 to 120 minutes and the mixture in step (b) is maintained at the temperature of 110° to 140° C. for a period of time in the range of 10 to 120 minutes, and the mixture in step (c) is maintained in the temperature range of about 320° to about 420° C. for a period of time in the range of about 5 minutes to about 2 hours.

21. A process according to claim 20 wherein said treating agent comprises diammonium hydrogen phosphate.

22. A process according to claim 16 wherein said lubricating oil and said treating agent are contacted in a first contactor at a temperature in the range of 60° to 120° C. for 10 minutes to 2 hours, and then contacted in a second contactor at a temperature in the range of 110° to 140° C. for 10 minutes to 2 hours, and then contacted in a third contactor at a temperature in the range of 140° to 200° C. for 10 minutes to 2 hours, and then in a fourth contactor at a temperature in the range of 320° to 420° C. for 5 minutes to 2 hours, wherein water in said admixture of said lubricating oil and said treating agent allowed to escape as vapor from said second, third and fourth contactors.

23. A process according to claim 22 wherein said treating agent comprises diammonium hydrogen phosphate.

24. A process according to claim 6 wherein said treating agent comprises diammonium hydrogen phosphate.

25. A process according to claim 1 wherein said treating agent is selected from the group consisting of ammonium sulfate, ammonium bisulfate, ammonium phosphate, diammonium hydrogen phosphate, ammonium dihydrogen phosphate, ammonium thiosulfate, ammonium polyphosphate, urea sulfate, guanidine sulfate, urea phosphate, and guanidine phosphate.

* * * * *

UNITED STATES PATENT AND TRADEMARK OFFICE

CERTIFICATE OF CORRECTION

PATENT NO. : 4,247,389

DATED : January 27, 1981

INVENTOR(S) : Marvin M. Johnson et al

It is certified that error appears in the above-identified patent and that said Letters Patent are hereby corrected as shown below:

Column 11, line 33, delete "wherin" and substitute therefor --- wherein ---.

Column 11, line 42, delete "20" and substitute therefor --- 120 ---.

Signed and Sealed this

*Fifth* Day of *May 1981*

[SEAL]

*Attest:*

RENE D. TEGTMEYER

*Attesting Officer*

*Acting Commissioner of Patents and Trademarks*

UNITED STATES PATENT AND TRADEMARK OFFICE

CERTIFICATE OF CORRECTION

PATENT NO. : 4,247,389

DATED : January 27, 1981

INVENTOR(S) : Marvin M. Johnson et al.

It is certified that error appears in the above—identified patent and that said Letters Patent is hereby corrected as shown below:

Columns 9 and 10, under "Ref. No.", delete "165" and substitute ---171---.

Signed and Sealed this

*Seventeenth* Day of *November 1981*

[SEAL]

*Attest:*

GERALD J. MOSSINGHOFF

*Attesting Officer*

*Commissioner of Patents and Trademarks*